US011454075B2

(12) United States Patent
Saruhashi et al.

(10) Patent No.: US 11,454,075 B2
(45) Date of Patent: Sep. 27, 2022

(54) CONTINUOUS DRILLING SYSTEM

(71) Applicants: Japan Agency for Marine-Earth Science and Technology, Yokosuka (JP); NuStar Technologies Pte Ltd, Singapore (SG)

(72) Inventors: Tomokazu Saruhashi, Yokosuka (JP); Ikuo Sawada, Yokosuka (JP); Masanori Kyo, Yokosuka (JP); Takahiro Yokoyama, Yokosuka (JP); Noriaki Sakurai, Yokosuka (JP); Ryan Bo Jia Wee, Singapore (SG); Chamal Jayanath Seneviratne, Singapore (SG); Kim Kok Goi, Singapore (SG); Sim Guan Teo, Singapore (SG)

(73) Assignees: Japan Agency for Marine-Earth Science and Technology, Yokosuka (JP); NuStar Technologies Pte Ltd, Singapore (SG)

( * ) Notice: Subject to any disclaimer, the term of this patent is extended or adjusted under 35 U.S.C. 154(b) by 247 days.

(21) Appl. No.: 16/961,916

(22) PCT Filed: Jan. 15, 2019

(86) PCT No.: PCT/JP2019/000920
§ 371 (c)(1),
(2) Date: Jul. 13, 2020

(87) PCT Pub. No.: WO2019/139166
PCT Pub. Date: Jul. 18, 2019

(65) Prior Publication Data

US 2020/0340318 A1 Oct. 29, 2020

(30) Foreign Application Priority Data

Jan. 15, 2018 (JP) ..... JP2018-004546

(51) Int. Cl.
*E21B 23/04* (2006.01)
*E21B 33/035* (2006.01)
*E21B 33/043* (2006.01)

(52) U.S. Cl.
CPC ..... *E21B 23/0411* (2020.05); *E21B 33/035* (2013.01); *E21B 33/043* (2013.01)

(58) Field of Classification Search
CPC .. E21B 23/0411; E21B 33/035; E21B 33/043; E21B 41/0007; E21B 33/038;
(Continued)

(56) References Cited

U.S. PATENT DOCUMENTS 3,404,736 A 10/1968 Nelson et al.
3,468,559 A 9/1969 Ahlstone
(Continued)

FOREIGN PATENT DOCUMENTS

JP 49006962 B 2/1974
JP 56097014 A 8/1981
JP 2004084199 A 3/2004

OTHER PUBLICATIONS

International Search Report, App. No. PCT/JP2019/000920, dated Apr. 2, 2019, 4 Pages.

*Primary Examiner* — Abby J Flynn
*Assistant Examiner* — Yanick A Akaragwe
(74) *Attorney, Agent, or Firm* — Berkeley Law & Technology Group, LLP

(57) ABSTRACT

A lock plug (7A) is inserted into a plug installation position of an insertion hole (5*a*) of a tool stem (5) connected to a drill string (10), and when a fluid has flowed to the insertion hole (5*a*), a stopper (62) protrudes radially outward from a tool body (6) and is locked to a subsea wellhead (4) and an internal stopper (66) protrudes radially inward from the tool body (6) and is locked to the tool stem (5) in a lock state. An
(Continued)

unlock plug is inserted into the plug installation position of the insertion hole (5*a*), and when the fluid has flowed into the insertion hole (5*a*), the stopper (62) is separated from the subsea wellhead (4) and the internal stopper (66) is separated from the tool stem (5) to release the lock state.

6 Claims, 9 Drawing Sheets

(58) Field of Classification Search
CPC ..... E21B 43/10; E21B 19/002; E21B 19/004; E21B 34/04
See application file for complete search history.

(56) References Cited

U.S. PATENT DOCUMENTS

| | | | | |
|---|---|---|---|---|
| 3,561,527 | A | 2/1971 | Nelson | |
| 3,837,684 | A | 9/1974 | Hynes | |
| 4,102,143 | A | 7/1978 | Phares et al. | |
| 4,893,678 | A * | 1/1990 | Stokley | E21B 33/127 166/239 |
| 5,259,459 | A | 11/1993 | Valka | |
| 2010/0007089 | A1 | 1/2010 | Adamek | |
| 2012/0305269 | A1 | 12/2012 | Bories et al. | |
| 2014/0166298 | A1 * | 6/2014 | Fenwick | E21B 33/04 166/360 |

* cited by examiner

CONTINUOUS DRILLING SYSTEM

Priority is claimed on Japanese Patent Application No. 2018-004546, filed in Japan on Jan. 15, 2018, and PCT Application PCT/JP2019/000920, filed on Jan. 15, 2019, the content of which are both incorporated herein by reference.

TECHNICAL FIELD

The present invention relates to a continuous drilling system.

Priority is claimed on Japanese Patent Application No. 0.018-004546, filed Jan. 15, 2018, the content of which is incorporated herein by reference.

BACKGROUND ART

In the related art, a drill bit is assembled at the lower end of a drill string and a removable wellhead running tool is fitted externally to the drill string directly above the drill bit as shown in, for example. Patent Document 1 as a method for performing offshore drilling from a drill ship/floating rig. A method is known in which a wellhead running tool equipped with a subsea wellhead and casings descends to the seabed. In this drilling method, the casing is installed on the seabed, and then the drill string is separated with respect to the wellhead running tool and the drill string is lowered with drill bit rotation. Continuous drilling can be performed as a result.

In the case of, for example, a shallow water depth of less than 3,000 m, the wellhead running tool of the related art has a mechanism separating a shaft portion and the main body of the wellhead running tool by rotating the entire drill string at the timing when lowering the wellhead finning tool with a remotely operated vehicle and the wellhead running tool reaches to the seabed. The separated drill string is configured to be moved up and down with respect to the main body with the shaft portion mounted.

In this case, a structure for separating the wellhead running tool with respect to the subsea wellhead as in the related art is not used. In other words, Patent Document 1 does not require a work process of pipe tripping in which the wellhead running tool mounted on the drill string is separated with respect to the subsea wellhead, the drill string and the wellhead running tool are temporarily pulled up onto the ship/floating rig, the drill string from which the wellhead running tool has been removed is run into the hole again inside the casing installed on the seabed, and drilling is performed. As a result, Patent Document 1 obtains advantageous of saving work time and cost reduction.

CITATION LIST

Patent Literature

[Patent Document 1]

Japanese Unexamined Patent Application, First Publication No. 2004-84199

SUMMARY OF INVENTION

Technical Problem

However, the continuous drilling method of the related art, in which the wellhead running tool is used and the shaft portion and the main body of the wellhead running tool are separated by rotation, is limited to installation work with the remotely operated vehicle at a shallow depth of less than 3,000 m. In the case of a large depth of 3,000 m or more, work is performed together with an underwater camera, and thus this causes a problem that an underwater camera cable wraps around a drill pipe when the drill string is rotated.

In the case of the large depth as mentioned above, the distance between the hanging point of the drill string on the ship/floating rig and the seabed becomes very large and the total length of the drill string becomes long. Accordingly, it is very difficult to perform rotation control because the number of rotations of the drill string on the ship/floating rig and the number of rotations of the release point on the seabed are unlikely to match.

In other words, actually, even if the number of rotations on the wellhead running tool is approximately five, the number of rotations on the ship/floating rig is often close to 20. In many cases, it is unclear how much torque is applied to the wellhead running tool side despite the necessity of continuous rotation torque application. Therefore, the mechanism of the related art for separation by rotation in deep water of 3,000 m or more is not suitable, and there is room for improvement in that respect.

The present invention has been made in view of the above-mentioned problems, and an object of the present invention is to provide a continuous drilling system with which it is possible to attach and detach subsea wellhead and tool body by hydraulic pressure without rotating a drill string and, even if an underwater camera along drill string is used in deep water, it is possible to prevent a nearby cable from being caught by the drill string.

Solution to Problem

A continuous drilling system according to one aspect of the present invention includes a casing which is installed at a borehole in a seabed, a tool stem which is assembled to a drill string hung from a ship/floating rig, an external tool body which is fitted to the tool stem and which is provided inside the subsea wellhead so as to be capable of being attached to and detached from the subsea wellhead, a locking protrusion which protrudes radially outward from the tool body and locked to an inner surface of the subsea wellhead, a projection which protrudes radially inward from the tool body and locked to the tool stem, and a lock plug and an unlock plug which are inserted into a plug installation position where the tool body and the subsea wellhead are mounted in an insertion hole of the tool stem. The lock plug is inserted into the plug installation position in the insertion hole, and when a fluid has flowed into the insertion hole, the locking protrusion protrudes and is locked to the inner surface of the subsea wellhead and the projection protrudes and is locked to the tool stein in a lock state. The unlock plug is inserted into the plug installation position in the insertion hole in place of the lock plug, and when the fluid has flowed into the insertion hole, the locking protrusion is separated from the subsea wellhead and the projection is separated from the tool stem to release the lock state.

According to the above aspect of the present invention, after the tool body including the tool stem is placed at a predetermined position of the subsea wellhead on a ship/floating rig, the lock plug is inserted into the plug installation position in the insertion hole of the tool stem and a fluid such as seawater or a drilling fluid flows. Therefore, the locking protrusion protrudes radially outward from the tool body and is locked inside the subsea wellhead. As a result, the subsea wellhead is mounted on the tool body to result in the lock state. Then, after the lock plug is pulled out, it is possible to hang the subsea wellhead and the tool body in the lock state by the drill string to the seabed and reach the bottom. When the subsea wellhead is separated from the tool body after the subsea wellhead and casing are installed, the unlock plug is thrown into the tool stem from the ship/floating rig via the drill string and can set at the plug installation position. Subsequently, the lock state is capable of being released by the fluid being pumped from the ship/floating rig.

As described above, in the above aspect of the present invention, it is possible to release the lock state between the tool body and the subsea wellhead without rotating the drill string unlike in the related art. Accordingly, even in the case of detachment work in deep water exceeding 3,000 m, for example, the difficult work of managing the rotation speed of the drill string is unnecessary and work efficiency is capable of being improved.

In the above aspect of the present invention, it is possible to prevent the inconvenience of a cable of a work monitoring device being caught as the drill string rotates even in a case where the work monitoring device such as an underwater camera, which is essential for work in deep water, is lowered along the drill string.

In the continuous drilling system according to a second aspect of the present invention, the lock plug may have a plug flow path portion allowing the fluid in the drill string to flow there through, the mounting tube may have a tube flow path portion communicating with the plug flow path portion at the plug installation position, and the locking protrusion may protrude from the tool body and be locked to the inner surface of the subsea wellhead by a pressure of the fluid flowing through the plug flow path portion.

According to a the above structure, the fluid pumped from the ship/floating rig into the drill string is capable of being used, the fluid is capable of flowing through the plug flow path portion of the lock plug inserted into the plug installation position in the insertion hole of the tool stem, and the fluid is capable of further flowing through the tube flow path portion of the tool body from the plug flow path portion. Then, the locking protrusion is capable of protruding by the pressure of the fluid and is capable of being locked inside the subsea wellhead. In this case, since the locking protrusion is configured to protrude by the pressure of the fluid, it is not necessary to mount a drive unit for making the locking protrusion appear and disappear on the tool body or the tool stem and a simple structure is achieved. As a result, operation in deep water is advantageously facilitated.

In the continuous drilling system according to a third aspect of the present invention, the locking protrusion may be separated from the inner surface of the subsea wellhead by the fluid in the tube flow path portion flowing out toward the plug flow path portion when the unlock plug is inserted into the plug installation position in the insertion hole in the lock state.

In this case, the fluid is allowed to flow out from the tube flow path portion toward the plug flow path portion in the lock state. As a result, the pressure acting on the locking protrusion is capable of being reduced, the locking protrusion is capable of being pulled inward in the radial direction, and the locking protrusion is capable of being separated from the inner surface of the subsea wellhead. In this case, since the locking protrusion is configured to be easily pulled in by the pressure of the fluid, a simple structure that does not require a drive unit for making the locking protrusion appear and disappear is achieved and operation in deep water is facilitated as described above.

In addition, in the continuous drilling system according to the present invention, a locking recess portion to which the locking protrusion is capable of being locked thereto may be formed in the inner surface of the subsea wellhead.

In this case, the locking protrusion is capable of being firmly locked with the locking recess portion since the locking protrusion is locked in the locking recess portion in the inner surface of the subsea wellhead.

Advantageous Effects of Invention

According to the continuous drilling system of the present invention, it is possible to attach and detach a subsea wellhead and a tool body without rotating a drill string and, even in deep water, it is possible to prevent a nearby cable from being caught by the drill string.

DESCRIPTION OF EMBODIMENTS

Figure 1A:
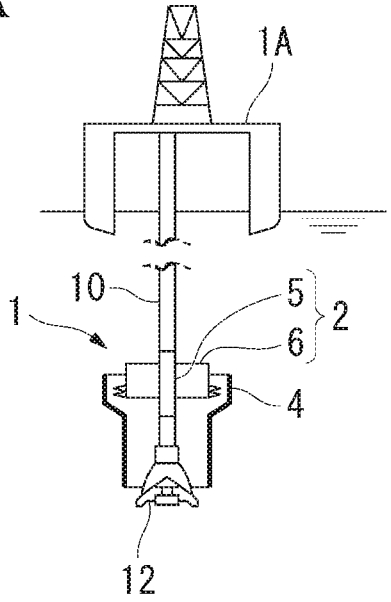
FIG. 1A is a diagram illustrating an offshore drilling procedure by means of a continuous drilling system according to an embodiment of the present invention.

Hereinafter, a continuous drilling system according to an embodiment of the present invention will be described with reference to the drawings.

As shown in FIGS. 1A to 1D, a continuous drilling system 1 of the present embodiment is a system for drilling a seabed G from a hull 1A such as a research vessel.

The continuous drilling system 1 includes a drill bit 12 at the lower end of a drill string 10. A wellhead running tool 2 is attached and detached with respect to the drill string 10 that is provided directly above the drill bit 12. The wellhead running tool 2 is externally fitted with the drill string 10. Further, in a state where a subsea wellhead 4 is mounted by the wellhead running tool 2, the wellhead running tool 2 on which the subsea wellhead 4 is mounted is lowered to the seabed G, landed, and installed. After the subsea wellhead 4 is installed, the subsea wellhead 4 provided in the wellhead running tool 2 is separated from a tool body 6 (described later), the drill string 10 is lowered together with the drill bit 12, and the drilling system of the present embodiment performs continuous drilling.

In the continuous drilling system 1 of the present embodiment, an operation monitoring device 8 equipped with an underwater camera that is provided above and in a vicinity of the wellhead running tool 2 is hung from the hull 1A along the drill string 10.

The hull 1A includes a drill floor for performing drilling operation in a substantially intermediate portion in the front-rear direction, a derrick mounted on the drill floor, and a moonpool in the hull 1A at a position below the drill floor. The sea surface is exposed in the moonpool. The drill string 10, the wellhead running tool 2, and the subsea wellhead 4 are thrown into the sea through the moonpool, and the seabed G is capable of being drilled down.

The drill string 10 has, for example, a unit length of 9 m. A hollow steel pipe screw-machined at both ends constitutes the drill string 10. The drill string 10 drills a hole in the seabed by a plurality of the drill strings 10 being lowered while being connected. During the drilling, the drill bit 12 is assembled to the lower end portion of the drill string 10 disposed at the lowermost end and the seabed G is capable of being drilled by the drill bit 12 rotating.

When the seabed G is drilled, a fluid R. (seawater and drilling fluid, see FIG. 2) is supplied from the hull 1A to the inside of the drill string 10. The seawater supplied to the inside of the drill string 10 descends in the drill string 10 and reaches the lower end portion of the pipe. The pressure of the seawater supplied at the lower end portion of the pipe causes the drill bit 12 to rotate, and the seabed G is drilled. The cuttings that are generated when the seabed G is drilled are mixed with the supplied seawater. Then, the drilling fluid mixed with the cuttings generated by the seabed G being drilled by means of the drill bit 12 is released into the sea.

Figure 2:
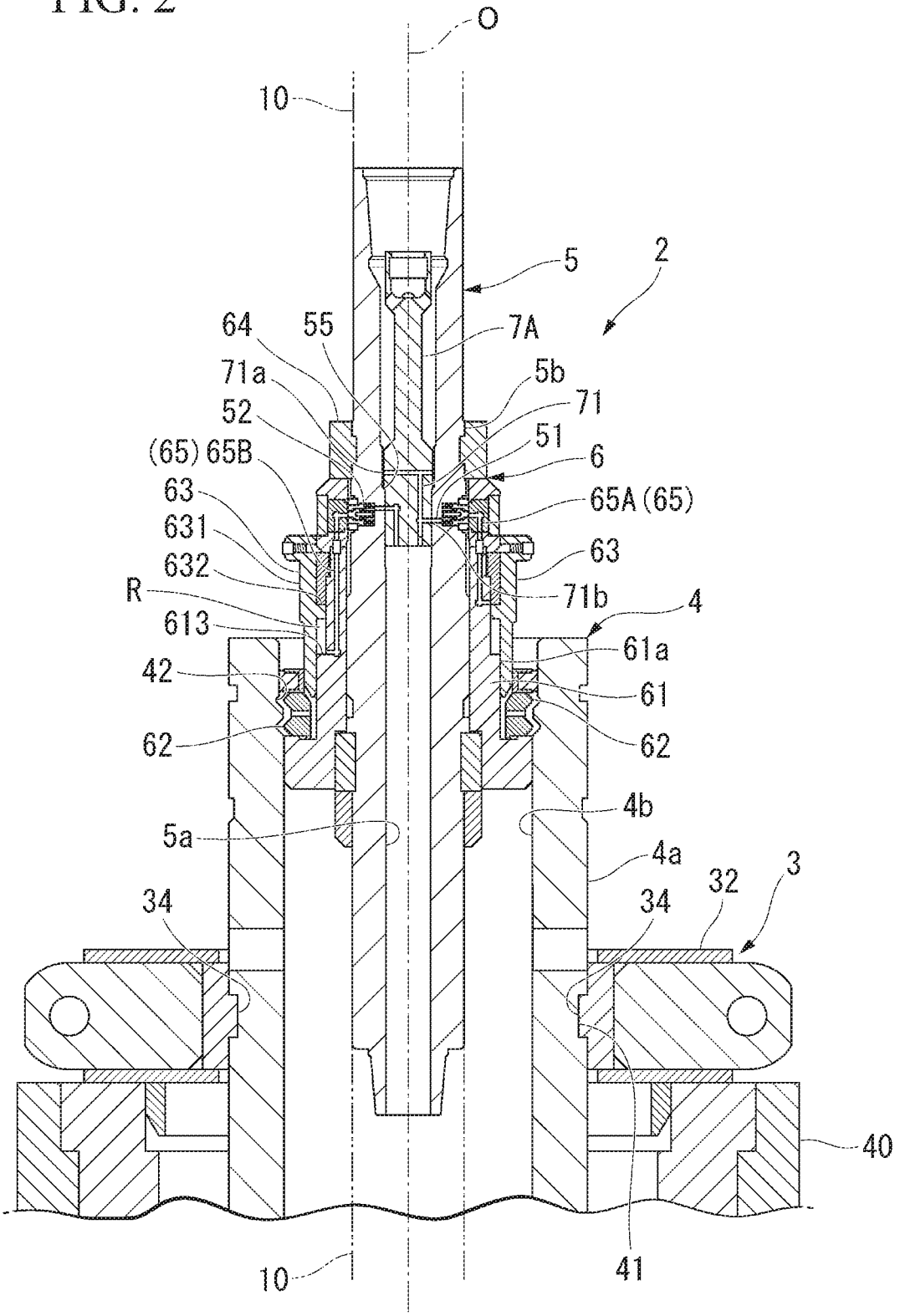
FIG. 2 is a longitudinal cross-sectional view illustrating a main part of a wellhead running tool.

Here, reference numeral 3 shown in FIG. 2 indicates a clamp for supporting the subsea wellhead 4 by means of the rig floor of the hull 1A or the moonpool when the wellhead running tool 2 and the subsea wellhead 4 are assembled into a lock state. A plurality of projecting locking portions 34 are provided at intervals in the circumferential direction on the clamp 3. These projecting locking portions 34 are provided so as to be capable of protruding toward the inside in the radial direction. In a state where the projecting locking portions 34 protrude, the projecting locking portions 34 are engaged, so as to be slidable in the circumferential direction, with an outer peripheral groove 41 (described later) formed in an outer peripheral surface 4*a* of the subsea wellhead 4.

The wellhead running tool 2 includes a tool stein 5 that is connected to a lower portion of the drill string 10 hung from the hull 1A, the tool body 6 that is attached to and detached from the subsea wellhead 4 and that is inserted through the subsea wellhead 4, and a lock plug 7A and an unlock plug 7B (see FIG. 7) that is capable of being inserted through an insertion hole 5*a* of the tool stem 5.

The subsea wellhead 4, the tool stem 5, the tool body 6, the lock plug 7A, and the unlock plug 7B are placed such that the respective central axes of the subsea wellhead 4, the tool stem 5, the tool body 6, the lock plug 7A, and the unlock plug 7B are positioned on a common axis. In the following description, this common axis is a drill axis O, the radial direction is orthogonal to the drill axis O in a plan view seen from the drill axis O, and the circumferential direction is an orbit around the drill axis O.

The subsea wellhead 4 is attached to the upper end of a casing.

The subsea wellhead 4 has a substantially cylindrical shape and is integrally connected to the above-described casing in a state of being welded from above. The outer peripheral groove 41 extending in the circumferential direction is formed at a substantially middle part of the outer peripheral surface 4*a* of the subsea wellhead 4 in the up-down direction. The plurality of projecting locking portions 34 of the clamp 3 described above are engaged with the outer peripheral groove 41 so as to be slidable in the circumferential direction. As a result, a movement of the subsea wellhead 4 in the up-down direction is restricted. It should be noted that the engagement between the projecting locking portion 34 of the clamp 3 and the outer peripheral groove 41 is used only when the tool body 6 and the subsea wellhead 4 are assembled.

A locking recess portion 42 in which a stopper 62 (described later) of the tool body 6 is capable of being locked is formed in the upper portion in an inner peripheral surface 4*b* of the subsea wellhead 4. The stopper 62 (described later) of the tool body 6 is capable of being be locked in the locking recess portion 42. The locking recess portion 42 forms a pair of circumferential grooves extending over the entire circumference in the circumferential direction.

Figure 3:
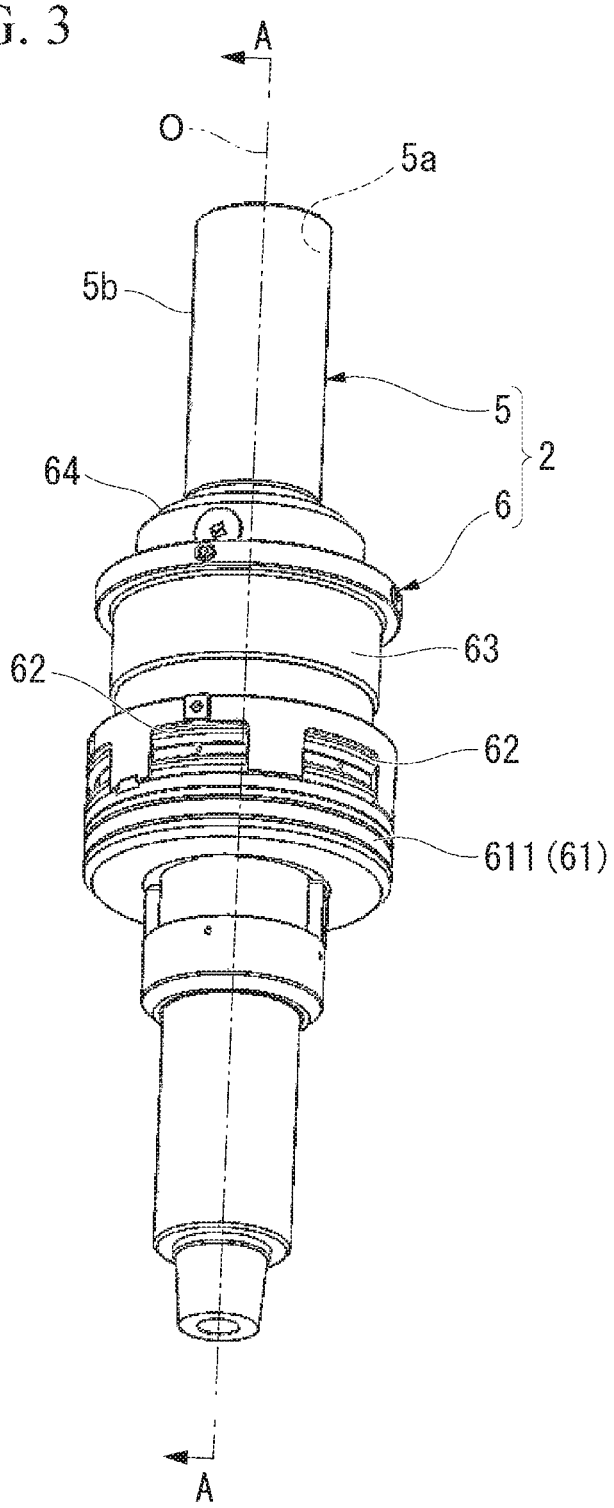
FIG. 3 is a perspective view illustrating the configuration of a tool body including a tool stem.

As shown in FIGS. 2 and 3, the tool body 6 includes a tube main body 61 that has a tube flow path portion 65 communicating with the inside of the tool stem 5 (a stem flow path portion 51 (described later)), the stopper 62 (locking protrusion) that is capable of protruding radially outward from an outer peripheral surface 61*a* of the tube main body 61, a slide ring 63 that is provided so as to be capable of moving up and down along the outer peripheral surface 61*a* of the tube main body 61 and moves the stopper 62 forward and backward in the radial direction, a stem clamp 64 that is provided in the upper portion of the tube main body 61 and is capable of being attached to and detached from an outer peripheral surface 5*b* of the tool stem 5, and an internal stopper 66 (projection) that is capable of protruding to the inside in the radial direction (inner surface of the tube main body 61).

Figure 4:
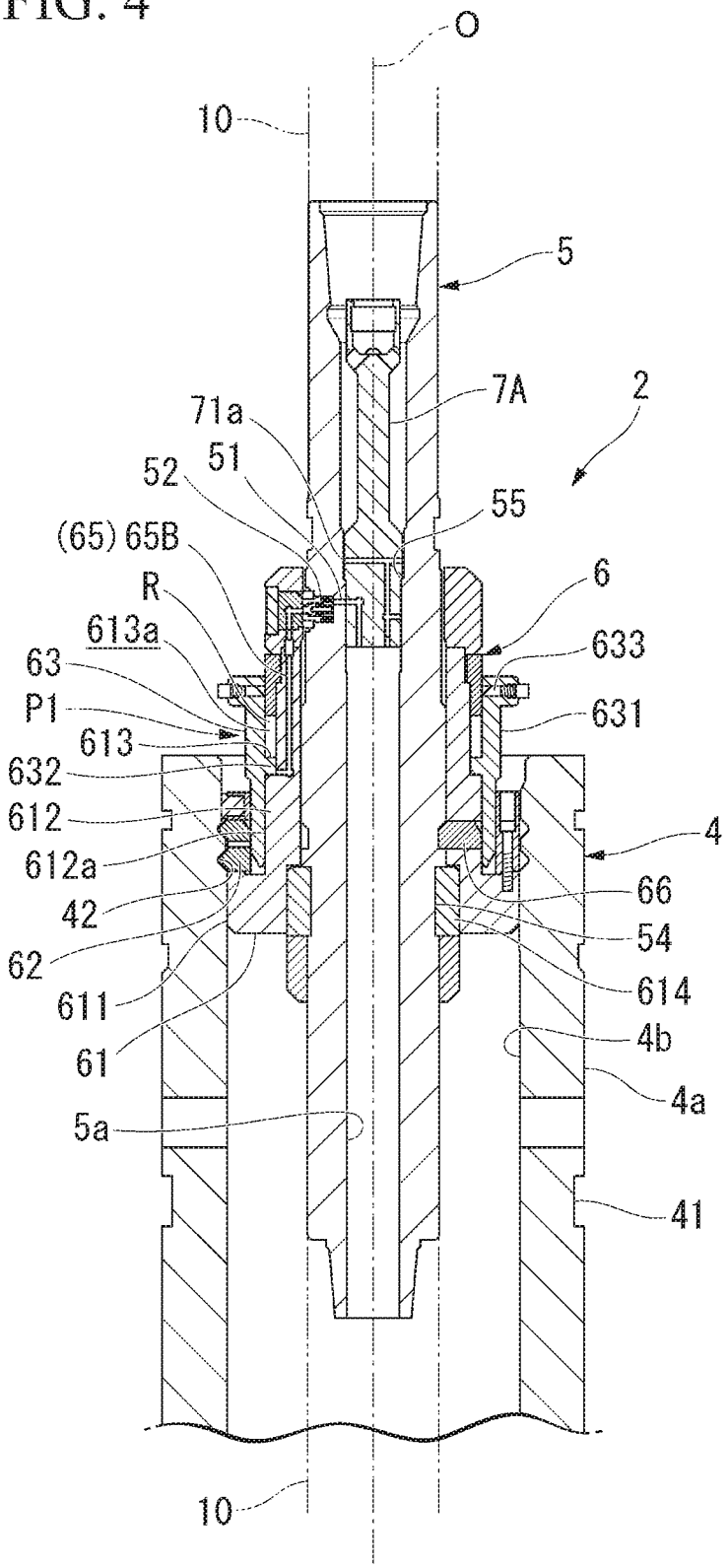
FIG. 4 is a longitudinal cross-sectional view illustrating the configuration of the subsea wellhead tool and is a diagram illustrating a lock state.
Figure 5:
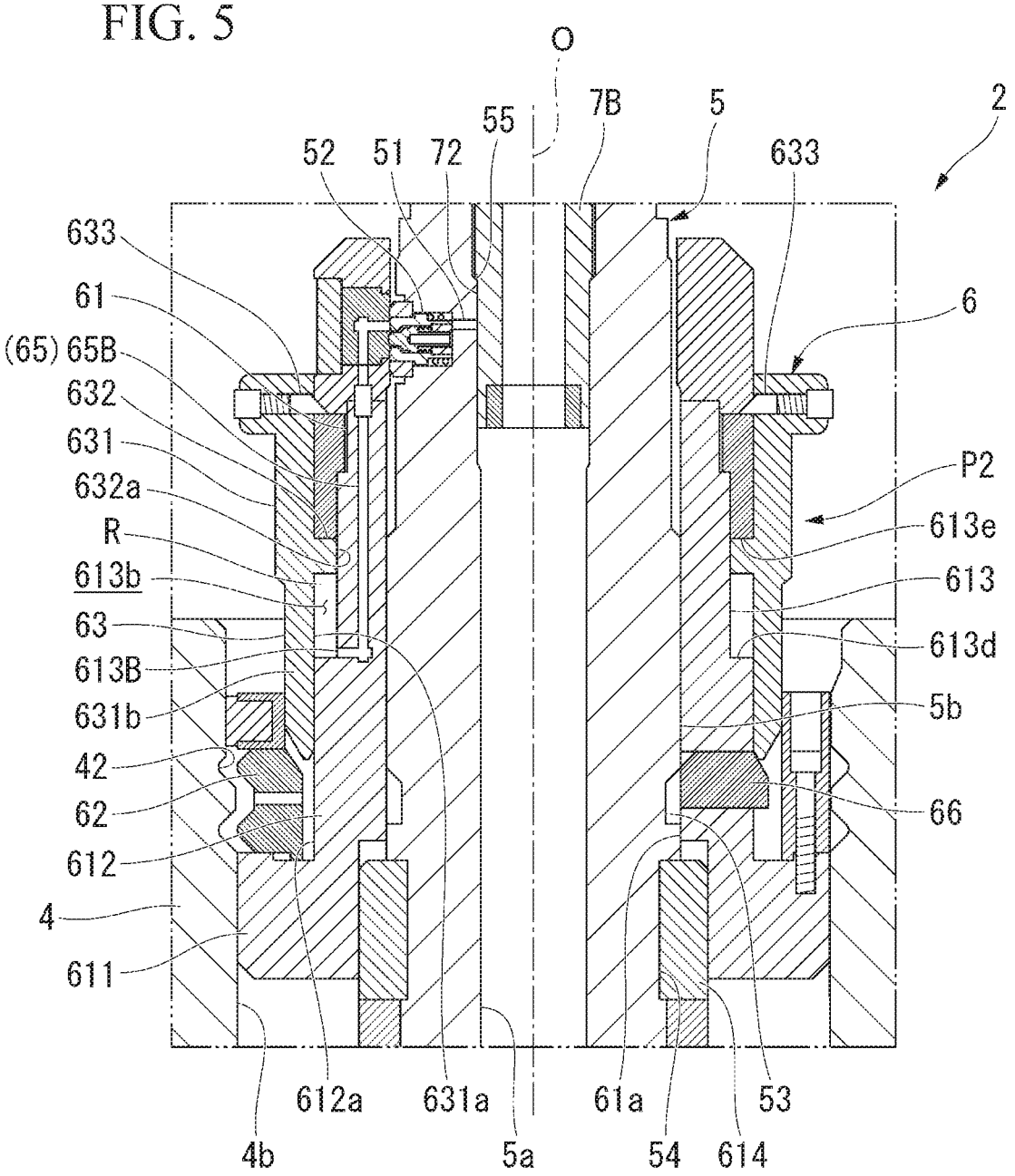
FIG. 5 is a longitudinal cross-sectional view illustrating a main part of the subsea wellhead tool and is a diagram illustrating an unlock state.
Figure 6:
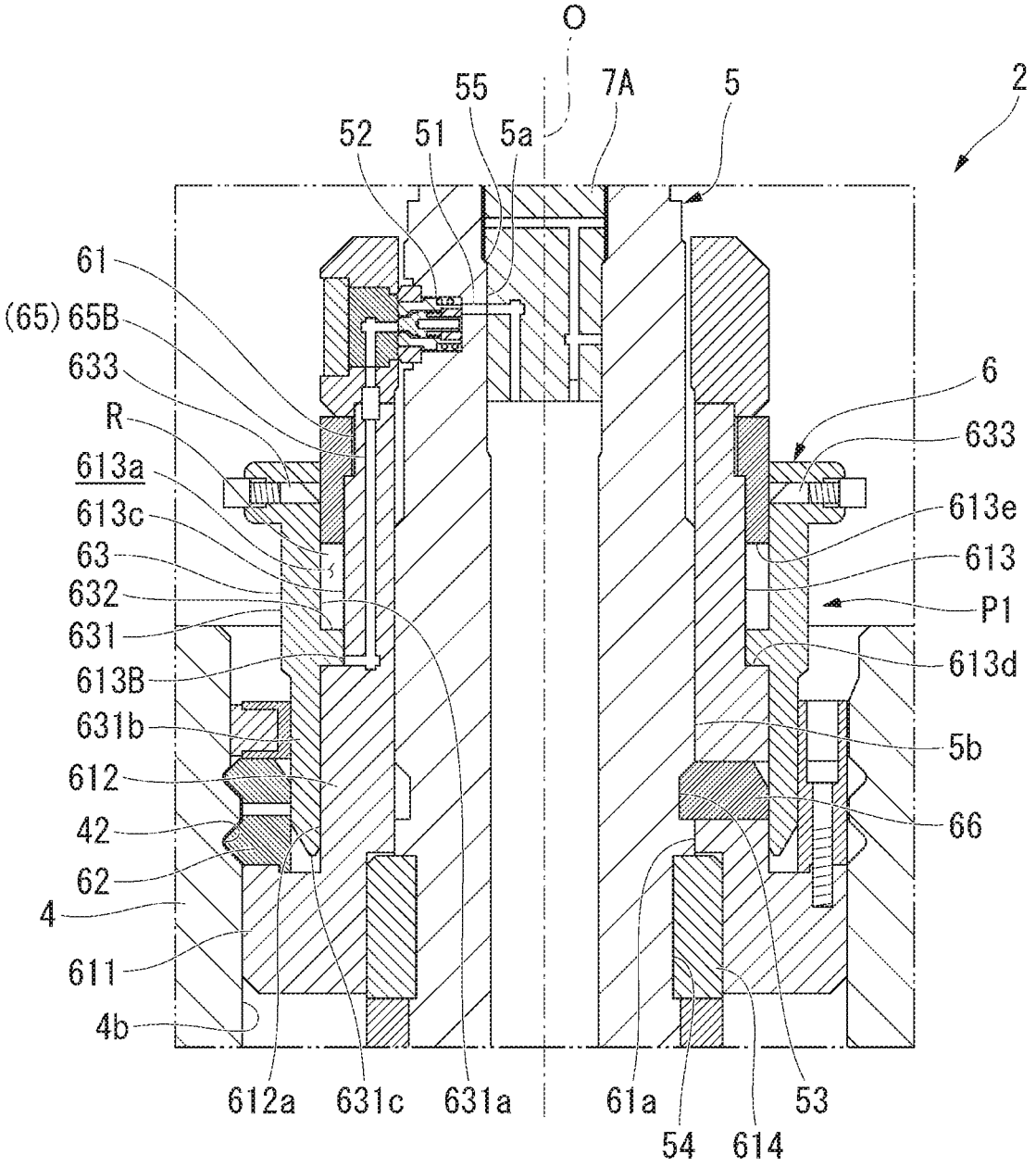
FIG. 6 is a longitudinal cross-sectional view illustrating a main part of the subsea wellhead tool and is a diagram illustrating the lock state.

As shown in FIGS. 4 to 6, the tube main body 61 has a flange portion 611 of which a lower end part overhangs to the outside in the radial direction and which supports the stopper 62 from below. Anti-Rotation block 614 is provided inside the flange portion 611. A key groove 54 for engaging the Anti-Rotation block piece 614 in a circumferentially non-rotatable manner is formed in the tool stem 5. In the tube main body 61, a guide groove 613 which extends along the circumferential direction and which is provided above the part (an outer peripheral surface 612*a*) where the stopper 62 is disposed is formed in a body portion 612 positioned above the flange portion 611.

The opening on the outer peripheral side of the guide groove 613 is liquid-tightly covered by the slide ring 63 and provided such that the fluid R is capable of flowing into the guide groove 613. A sliding piece 632 (described later) of the slide ring 63 is configured to slide in the up-down direction in the guide groove 613 in accordance with the pressure of the fluid R. The intra-groove space of the guide groove 613 is partitioned by the sliding piece 632 and is divided into upper and lower regions.

In other words, when the sliding piece 632 is positioned at the upper end of the guide groove 613 (this is referred to as an unlock position P2), the fluid R is pressed into a lower groove space 613*b* formed on the lower side of the sliding piece 632. On the other hand, when the sliding piece 632 is positioned at the lower end of the guide groove 613 (this is referred to as a lock position P1), the fluid R is pressed into an upper groove space 613*a* formed on the upper side of the sliding piece 632.

Here, the fluid R that is adopted in the present embodiment is pumped through the drill string 10 from the hull 1A shown in FIG. 1.

Figure 7:
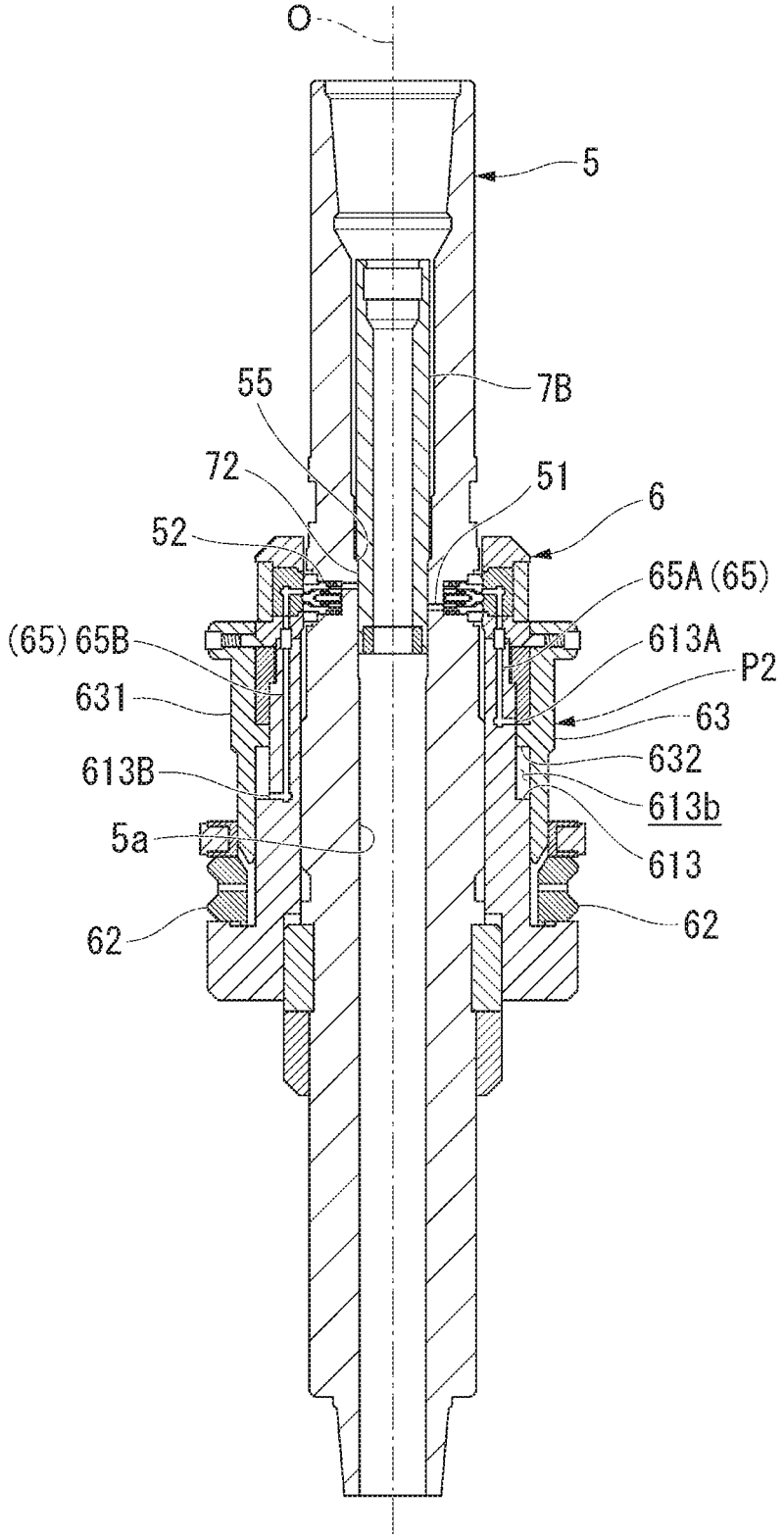
FIG. 7 is a longitudinal cross-sectional view illustrating the unlock state of the tool body including the tool stein.

As shown in FIG. 7, a flow path hole 613A connected to the tube flow path portion 65 (a first flow path 65A (described later)) is provided in the upper portion of the groove bottom surface in the guide groove 613. A flow path hole 613B connected to the tube flow path portion 65 (a second flow path 65B (described later)) is provided in the lower portion of the groove bottom surface in the guide groove 613. In other words, the first flow path hole 613A communicates with the upper groove space 613*a* (see 6) divided by the sliding piece 632 of the slide ring 63. The second flow path hole 613B communicates with the lower groove space 613*b* divided by the sliding piece 632 of the slide ring 63.

The above-described tube flow path portion 65 provided inside the tube main body 61 has the first flow path 65A and the second flow path 65B. One end of the first flow path 65A and one end of the second flow path 65B communicate with the guide groove 613. The other end of the first flow path 65A and the other end of the second flow path 65B communicate with the inside of the tool stem 5 (a first plug flow path portion 71 shown in FIG. 2). When the sliding piece 632 is positioned at the unlock position P2 if the fluid R flows into the upper groove space 613*a* from the inside of the tool stem 5 through the first flow path 65A, the pressure of the fluid. R causes the fluid R in the lower groove space 613*b* to flow out to the tool stem 5 through the second flow path 65B, and the sliding piece 632 moves downward.

As shown in FIGS. 5 and 6, a plurality of the stoppers 62 are provided at intervals in the circumferential direction and each of the stoppers 62 is placed to the outer peripheral surface 612*a* of the body portion 612 of the tool body 6 so as to be capable of protruding outward in the radial direction. The stopper 62 is provided such that a push-in portion 631*b* of the lower portion of a ring main body 631 of the slide ring 63 is pushed in between the outer peripheral surface 612*a* of the body portion 612 and the stopper 62. Then, when the push-in portion 631*b* pushed in between the body portion 612 and the stopper 62, the stopper 62 protrudes toward a direction away from the outer peripheral surface 612*a* of the body portion 612 (outward in the radial direction) as shown in FIG. 6, is locked into the locking recess portion 42 formed in the inner peripheral surface 4*b* of the subsea wellhead 4, and reaches the lock position P1. Accordingly, the length of protrusion of the stopper 62 corresponds to the thickness dimension of the ring main body 631. In addition, when the push-in portion 631*b* is removed from between the stopper 62 and the body portion 612, the stopper 62 becomes free and unrestrained and the slide ring 63 is positioned at the unlock position P2 (see FIG. 5) at which the stopper 62 is unlocked from the locking recess portion 42 of the subsea wellhead 4 and the lock state is released.

As shown in FIGS. 5 and 6, the body portion 612 of the tool body 6 is including a plurality of the internal stoppers 66 capable of protruding to the inside in the radial direction (inner surface of the tube main body 61) at positions that are spaced apart in the circumferential direction and do not overlap the above-described stopper 62 in the circumferential direction. As shown in FIG. 6, when the slide ring 63 is positioned at the lock position P1, the internal stopper 66 protrudes inward by the push-in portion 631*b* of the slide ring 63 and is locked in a second locking recess portion 53 formed in the outer peripheral surface 5*b* of the tool stem 5. As a result, the tool body 6 and the tool stem 5 are locked. As shown in FIG. 5, the internal stopper 66 becomes free and unrestrained when the slide ring 63 is positioned at the unlock position P2. As a result, the tool body 6 and the tool stem 5 are unlocked.

The slide ring 63 has the ring main body 631, the sliding piece 632, and a locking pin 633.

The ring main body 631 covers the opening of the guide groove 613 of the tube main body 61 and is externally fitted with the body portion 612 so as to be capable of moving up and down along the outer peripheral surface 612*a*. The sliding piece 632 is provided on an inner surface 631*a* of the ring main body 631 and slides in the up-down direction by the pressure of the fluid R in the guide groove 613. The locking pin 633 is capable of being locked in the upper portion of the tube main body 61 in the upper portion of the ring main body 631.

The ring main body 631 is in liquid-tight contact by a packing seal at upper and lower positions of the guide groove 613 in the body portion 612 of the tube main body 61. As a result, a liquid-tight state is maintained such that the fluid R in the guide groove 613 does not leak out even when the slide ring 63 moves up and down. A taper 631*c* gradually becoming inward and downward is formed at the lower end of the ring main body 631. The lower end of the ring main body 631 is configured to be easily pushed in between the stopper 62 and the outer peripheral surface 612*a* of the body portion 612 by the shape of the taper 631*c*.

The sliding piece 632 protrudes inward in the radial direction over the entire circumference in the circumferential direction at the middle part of the inner surface 631*a* of the ring main body 631 in the up-down direction. The length of protrusion of the sliding piece 632 is equal to the depth dimension of the guide groove 613. A protruding end 632*a* of the sliding piece 632 liquid-tightly abuts a bottom surface 613*c* of the guide groove 613.

As shown in FIG. 6, the sliding piece 632 reaches a position of abutment with a lower end 613*d* of the guide groove 613 when the push-in portion 631*b* of the ring main body 631 is positioned at the lock position P1 of push into a predetermined position between the stopper 62 and the body portion 612. As shown in FIG. 5, the sliding piece 632 reaches a position of abutment with an upper end 613*e* of the guide groove 613 when the push-in portion 631*b* is positioned at the unlock position P2 of removal from between the stopper 62 and the body portion 612. In other words, the sliding piece 632 abuts the lower end 613*d* of the guide groove 613 when the fluid R is pumped into the upper groove space 613*a* of the guide groove 613, and the sliding piece 632 abuts against the upper end 613*e* of the guide groove 613 when the fluid R is pumped into the lower groove space 613*b*.

As shown in FIG. 2, the stem clamp 64 is configured to extend in the circumferential direction and grip the outer peripheral surface 5*b* of the tool stem 5 from the outside so as to be capable of being attached to and detached from the tool stem 5.

As shown in FIGS. 2 and 7, the tool stem 5 has a tubular shape and the upper and lower ends of the tool stem 5 are connected to the drill string 10. The insertion hole 5*a* is formed inside the tool stem 5. Two types of plugs are inserted into the insertion hole 5*a*. One is the lock plug 7A (see FIG. 2) for locking the tool body 6 with respect to the subsea wellhead 4, and the other is the unlock plug 7B (see FIG. 7) for releasing the lock state of the tool body 6 with respect to the subsea wellhead 4.

The stem flow path portion 51 is provided at the middle part of the tool stem 5 in the up-down direction. One end of the stem flow path portion 51 is open to the outer peripheral surface 5*b* and is capable of communicating with the tube flow path portion 65 (first flow path 65A, second flow path 65B) provided in the tube main body 61 of the tool body 6. The other end of the stem flow path portion 51 is open to the insertion hole 5*a* and is capable of communicating e first plug flow path portion 71 of the lock plug 74 and a second plug flow path portion 72 formed in the outer peripheral portion of the unlock plug 7B.

A check valve 52 is provided in the stem flow path portion 51. This check valve 52 restricts a backflow to the stem flow path portion 51 of the fluid R that has flowed front the stem flow path portion 51 to the tube flow path portion 65.

A plug support portion 55 supporting the lock plug 74 and the unlock plug 7B such that the lock plug 7A and the unlock plug 7B positions at predetermined insertion positions is formed in the insertion hole 5*a*.

The lock plug 7A has the first plug flow path portion 71 as shown in FIG. 2. A first flow path port 71*a* of one end of the first plug flow path portion 71 is connected to the inside of the insertion hole 5*a* of the tool stem 5. A second flow path port 71*b* of the other end of the first plug flow path portion 71 is communicated to the stem flow path portion 51 and the first flow path 65A of the tool body 6.

At the position where the lock plug 7A is inserted into the insertion hole 5*a* of the tool stem 5 and locked to a plug support portion (not shown), the second flow path port 71*b* of the first plug flow path portion 71 is connected to the flow path port of the stem flow path portion 51 opening inside the tool stem 5.

As shown in FIG. 5, the unlock plug 7B is inserted into the insertion hole 5*a* of the tool stem 5 in place of the lock plug 7A described above.

The unlock plug 7B forms the second plug flow path portion 72. The second plug flow path portion 72 is formed between the outer peripheral side of the unlock plug 7B and the insertion hole 5*a*, and communicates with the stem flow path portion 51 and the second flow path 65B of the tool body 6. At the position where the unlock plug 7B is inserted into the insertion hole 5*a* of the tool stem 5 and locked to a plug support portion, the second plug flow path portion 72 is connected to the flow path port of the stem flow path portion 51 opening inside the tool stem 5.

Figure 1B:
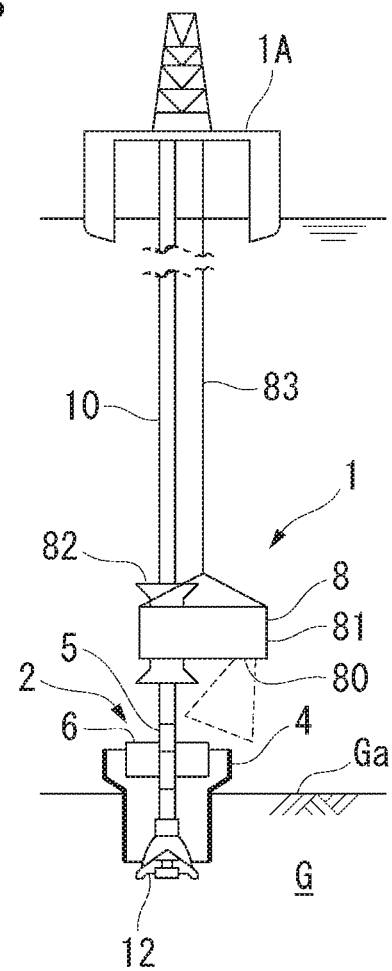
FIG. 1B is a diagram illustrating the offshore drilling procedure by means of the continuous drilling system according to the embodiment of the present invention.

As shown in FIG. 1B, the operation monitoring device 8 has a device main body 81, a guide tube 82, and a cable 83.

The device main body 81 includes an underwater camera 80. The drill string 10 is inserted through the guide tube 82. The guide tube 82 fixes the device main body 81 and is capable of being moved up and down along the drill string 10. The cable 83 hangs the device main body 81 from the hull 1A. The device main body 81 is deployed by the cable 83 being moved up and down from the hull 1A so as to be positioned above the wellhead running tool 2.

Next, a procedure for drilling the seabed G by using the above-described continuous drilling system 1 and the action of the continuous drilling system 1 will be described with reference to the drawings.

As shown in FIG. 1A, the subsea wellhead 4 is installed on the seabed G using the wellhead running tool 2 when the seabed G is drilled.

First, on the hull 1A, the tool body 6 including the tool stem 5 is placed at a predetermined position with respect to the subsea wellhead 4. Subsequently, as shown in FIG. 2, the lock plug 7A is inserted into the insertion hole 5*a* of the tool stem 5 and is disposed at the lock position P1 (see FIG. 4). The predetermined position is a position where the stopper 62 of the tool body 6 and the locking recess portion 42 formed in the inner surface of the subsea wellhead 4 face each other in the horizontal direction. It should be noted that an appropriate number of the drill strings 10 may be connected to the upper end of the tool stem 5 during the work on the hull 1A. In addition, an appropriate number of the drill strings 10 and an appropriate number of the drill bit 12 are provided at the lower end of the tool stem 5. Here, a motor (not shown) for drill driving is provided directly above the drill bit 12.

At this time, the tool stem 5 is mounted at a predetermined fixing position with respect to the tool body 6, and the stem flow path portion 51 is disposed in a state of communicating with the tube flow path portion 65 of the tool body 6. It should be noted that the stopper 62 of the tool body 6 does not protrude outward in the radial direction (is positioned at the unlock position P2) and the slide ring 63 is disposed at an upper position of non-contact with the stopper 62 in this state.

Next, the fluid R flows through the first plug flow path portion 71 of the lock plug 7A when the fluid R is pumped from the hull 1A into the insertion hole 5*a* of the tool stem 5. In other words, the fluid R flows through the lock plug 7A from the first flow path port 71*a* of the first plug flow path portion 71 toward the second flow path port 71*b*. The fluid R passes through the stem flow path portion 51 of the tool stem 5 connected to the second flow path port 71*b* and flows into the first flow path 65A of the tool body 6. At this time, the fluid R flowing through the first plug flow path portion 71 in the lock plug 7A does not flow to the second flow path 65B of the tool body 6.

As shown in FIG. 2, the fluid R that has flowed through the first flow path 65A flows into the upper groove space 613*a* of the guide groove 613 of the tool body 6 and the sliding piece 632 of the slide ring 63 is pushed down by the pressure of the fluid R. As a result, the slide ring 63 slides downward and is pushed in between the stopper 62 and the body portion 612 of the tool body 6 from above. As a result, the stopper 62 protrudes outward in the radial direction and is locked into the locking recess portion 42 formed in the inner surface of the subsea wellhead 4. At the same time, the internal stopper 66 also works and locks the tool stem 5 and the tool body 6. As a result, the subsea wellhead 4 integrally provided by the tool body 6 including the tool stem 5 is mounted in a locked state. The lock side and the unlock side at this time are balanced, and thus the lock state is maintained. Further, a locking pin (not shown) provided on the tool body 6 is inserted into the outer periphery of the tool stem 5 and locked.

Subsequently, as shown in FIG. 19, the subsea wellhead 4 mounted on the wellhead running tool 2 is lowered toward the seabed while the drill string 10 is sequentially added to the upper end of the tool stem 5, is hung down to the seabed G, and reaches the bottom. At this time, the operation monitoring device 8 where the underwater camera 80 is mounted along the drill string 10 is provided at a position directly above the wellhead running tool 2 and the operation monitoring device 8 is hung at the same time as the wellhead running tool 2. As a result, in this configuration, the operation monitoring device 8 is capable of monitoring the state of the wellhead running tool 2 with the hull 1A.

Then, at a timing when the lower end of the subsea wellhead 4 reaches the bottom, embedding of the subsea wellhead 4 in the seabed G is initiated while the seabed G is drilled by the drill bit slightly protruding from the subsea wellhead 4.

Next, a step of separating the tool body 6 from the subsea wellhead 4 after the subsea wellhead 4 reaches the bottom will be described.

First, after fixing is performed on the ship/floating rig as shown in FIG. 2, the lock plug 7A inserted in the insertion hole 5*a* of the tool stem 5 is pulled up. At this time, the lock state is maintained as described above even when the lock plug 7A is pulled up.

Subsequently, as shown in FIG. 5, the unlock plug 7B is disposed at the plug installation position of the tool stem 5 and the second flow path 65B of the tool body 6 communicates with the second plug flow path portion 72 of the unlock plug 7B. Then, when the fluid R is pumped from the hull 1A into the insertion hole 5*a* of the tool stem 5, the fluid R flows through the second plug flow path portion 72 formed on the outer peripheral side of the unlock plug 7B. The fluid R flows into the stem flow path portion 51 of the tool stem 5 and further flows into the second flow path 65B of the tool body 6. At this time, the fluid R flowing through the second plug flow path portion 72 in the unlock plug 7B does not flow into the first flow path 65A of the tool body 6.

The fluid R that has flowed through the second flow path 65B flows into the lower groove space 613*b* of the guide groove 613 of the tool body 6 and the sliding piece 632 of the slide ring 63 is pushed up by the pressure of the fluid R. As a result, the slide ring 63 slides upward, is removed from between the stopper 62 and the body portion 612 of the tool body 6, and the stopper 62 is released. As a result, the locking state of the subsea wellhead 4 with respect to the locking recess portion 42 is released, the lock state is released, and the slide ring 63 is positioned at the unlock position P2. As a result, the tool body 6 including the tool stem 5 is capable of being separated from the subsea wellhead 4 provided integrally in the subsea wellhead 4.

By the slide ring 63 sliding upward, the lock of the stopper 62 is released and, at the same time and as shown in FIG. 5, the lock by the internal stopper 66 that puts the tool stem 5 into the lock state is also released.

In the slide ring 63, the locking pin 633 biased by a spring at a position pushed up to a rise position locks in the body portion 612 of the tube main body 61. The rise position is held and the unlock state is maintained as a result.

Figure 1C:
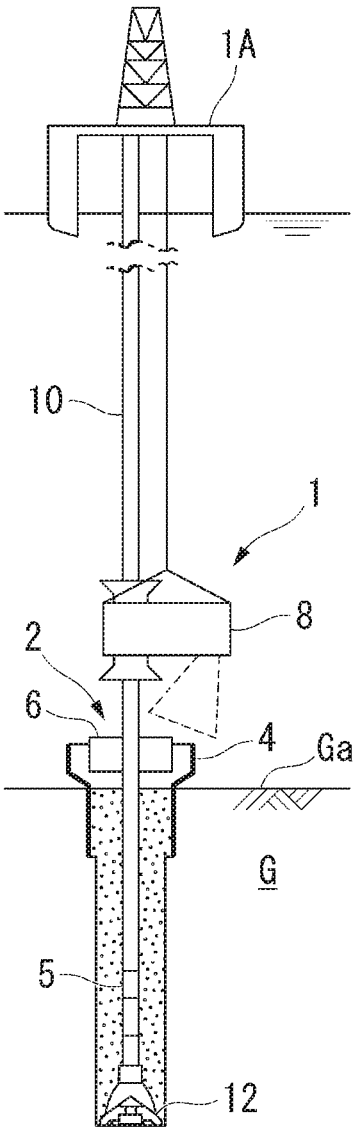
FIG. 1C is a diagram illustrating the offshore drilling procedure by means of the continuous drilling system according to the embodiment of the present invention.

Next, the tool stem 5 is separated from the tool body 6 with the tool body 6 placed on the subsea wellhead 4 as shown in FIG. 1C and the seabed G is drilled by means of the drill bit 12 while the separated tool stem 5 is lowered together with the drill string 10.

Figure 1D:
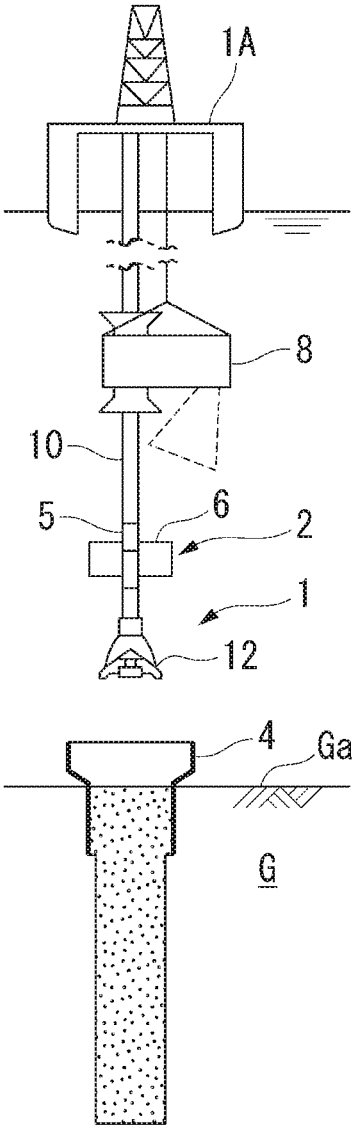
FIG. 1D is a diagram illustrating the offshore drilling procedure by means of the continuous drilling system according to the embodiment of the present invention.

Further, drilling of a predetermined depth is completed by means of the drill bit 12. After that, as shown in FIG. 1D, the drill bit 12 is pulled up together with the drill string 10 and the tool body 6 that is free and unrestrained and a series of drilling work is completed.

As described above and as shown in FIGS. 1A to 1D, in the above-described continuous drilling system 1, it is possible to release the lock state between the tool body 6 and the subsea wellhead 4 without rotating the drill string 10 unlike in the related art. The continuous drilling system 1 is capable of being used regardless of the depth. Particularly, even in the case of detachment work in deep water such as 7,000 m exceeding 3,000 m, the difficult work of managing the rotation speed of the drill string 10 is unnecessary and work efficiency is capable of being improved.

In addition, in the present embodiment, it is possible to prevent the inconvenience of the cable 83 of the operation monitoring device 8 being caught as the drill string 10 rotates even in a case where the work monitoring device 8 such as an underwater camera, which is essential for work in deep water, is disposed along the drill string 10.

In addition, as shown in FIGS. 2 and 7, in the continuous drilling system 1 of the present embodiment, the fluid R pumped from the ship/floating rig into the drill string 10 is capable of being used, the fluid R is capable of flowing through the plug flow path portions 71 and 72 of the lock plug 7A and the unlock plug 7B inserted into the plug installation position in the insertion hole 5*a* of the tool stem 5, and the fluid R is capable of further flowing through the tube flow path portion 65 of the tool body 6 from the plug flow path portions 71 and 72. Then, the stopper 62 is capable of protruding by the pressure of the fluid R and is capable of being locked inside the subsea wellhead 4.

In this case, since the stopper 62 and the internal stopper 66 are configured to protrude by the pressure of the fluid R, it is not necessary to mount a drive unit for making the stopper 62 appear and disappear on the tool body 6 or the tool stem 5, a simple structure is achieved, and operation in deep water is advantageously facilitated.

Further, in the lock state in the present embodiment, the fluid R applied to the stopper 62 and the internal stopper 66 flows from the tube flow path portion 65 and, as a result, the pressure acting on the stopper 62 is capable of being reduced, the stopper 62 is capable of being pulled inward in the radial direction, and the stopper 62 is capable of being separated from the inner surface of the subsea wellhead 4. In this case, since the stopper 62 is configured to be easily pulled in by the pressure of the fluid, a simple structure that does not require a drive unit for making the stopper 62 appear and disappear is achieved and operation in deep water is facilitated as described above.

In the present embodiment, the stopper 62 is locked in the locking recess portion 42 of the inner surface of the subsea wellhead 4 and the internal stopper 66 is also engaged with respect to the inner surface of the tool stem 5. Finn locking is possible as a result. Further, since the locking pin (not shown) provided on the tool body 6 is inserted into the outer periphery of the tool stem 5 and locked in this configuration, unlock is possible only when a predetermined pressure is applied.

As described above, in the continuous drilling system 1 according to the present embodiment, it is possible to attach and detach the subsea wellhead 4 and the tool body 6 without rotating the drill string 10 and, even in deep water, it is possible to prevent a nearby cable from being caught by the drill string 10.

Although an embodiment of the continuous drilling system according to the present invention has been described above, the present invention is not limited to the above-described embodiment and is capable of being appropriately modified without departing from the spirit of the present invention.

For example, methods for using the fluid R are not limited although the fluid R flows through the plug flow path portions 71 and 72 of the lock plug 7A and the unlock plug 7B and the tube flow path portion 65 and the stopper 62 is driven by the pressure of the fluid R as a configuration moving the stopper 62 of the tool body 6 forward and backward in the direction of protrusion in the present embodiment. For example, a configuration is also possible in which the stopper 62 protrudes by the slide ring 63 being mechanically pushed down when the lock plug 7A and the unlock plug 7B are inserted into predetermined positions of the insertion hole 5*a* of the tool stem 5.

Although the work of lock or unlock of the tool body 6 and the subsea wellhead 4 as described above is monitored by the operation monitoring device 8 being disposed along the drill string 10 and above the wellhead running tool 2 at all times in the present embodiment, the present invention is not limited to providing the operation monitoring device 8 in this manner.

In addition, it is appropriately possible to replace components in the above-described embodiment with known components without departing from the spirit of the present invention.

INDUSTRIAL APPLICABILITY

According to the continuous drilling system of the present invention, it is possible to attach and detach a subsea wellhead and a tool body without rotating a drill string and, even in deep water, it is possible to prevent a nearby cable from being caught by the drill string.

REFERENCE SIGNS LIST

1 Continuous drilling system
2 Wellhead running tool
3 Clamp
4 Subsea wellhead
5 Tool stem
5*a* Insertion hole
6 Tool body
7A Lock plug
7B Unlock plug
8 Operation monitoring device
10 Drill string
12 Drill bit
42 Locking recess portion
51 Stem flow path portion
52 Check valve
55 Plug support portion
61 Tube main body
62 Stopper (locking protrusion)
63 Slide ring
632 Sliding piece
65 Tube flow path portion
65A First flow path
65B Second flow path
66 Internal stopper (projection)
71 First plug flow path portion
72 Second plug flow path portion
G Seabed
P1 Lock position
P2 Unlock position

The invention claimed is:

1. A continuous drilling system comprising:

a subsea wellhead and casing which are installed at a borehole drilled in a seabed;

a tubular tool stem which is connected to a drill string hung from a ship/floating rig;

an external tool body which is fitted to the tool stem and which is provided inside the subsea wellhead so as to be capable of being attached to and detached from the subsea wellhead;

a locking protrusion which protrudes radially outward from the tool body and locked to an inner surface of the subsea wellhead;

a projection which protrudes radially inward from the tool body and locked to the tool stem; and a lock plug and an unlock plug which are inserted into a plug installation position where the tool body and the subsea wellhead are mounted in an insertion hole of the tool stem, wherein the lock plug is inserted into the plug installation position in the insertion hole, and when a fluid has flowed into the insertion hole, the locking protrusion protrudes and is locked to the inner surface of the subsea wellhead and the projection protrudes and is locked to the tool stem in a lock state, and the unlock plug is inserted into the plug installation position in the insertion hole in place of the lock plug, and when the fluid has flowed into the insertion hole, the locking protrusion is separated from the subsea wellhead and the projection is separated from the tool stem to release the lock state.

2. The continuous drilling system according to claim 1, wherein the lock plug has a plug flow path portion allowing the fluid in the drill string to flow there through and the tool body has a tube flow path portion communicating with the plug flow path portion at the plug installation position, and the locking protrusion protrudes from the tool body and is locked to the inner surface of the subsea wellhead by a pressure of the fluid flowing through the plug flow path portion.

3. The continuous drilling system according to claim 2, wherein the locking protrusion is separated from the inner surface of the subsea wellhead by the fluid in the tube flow path portion flowing out toward the plug flow path portion when the unlock plug is inserted into the plug installation position in the insertion hole in the lock state.

4. The continuous drilling system according to claim 3, wherein a locking recess portion to which the locking protrusion is capable of being locked is formed in the inner surface of the subsea wellhead.

5. The continuous drilling system according to claim 2, wherein a locking recess portion to which the locking protrusion is capable of being locked is formed in the inner surface of the subsea wellhead.

6. The continuous drilling system according to claim 1, wherein a locking recess portion to which the locking protrusion is capable of being locked is formed in the inner surface of the subsea wellhead.

* * * * *